United States Patent [19]

Kulke et al.

[11] 4,266,729

[45] May 12, 1981

[54] INJECTION VALVE FOR FUEL INJECTION SYSTEMS

[75] Inventors: Günther Kulke, Esslingen; Waldemar Hans, Bamberg, both of Fed. Rep. of Germany

[73] Assignee: Robert Bosch GmbH, Stuttgart, Fed. Rep. of Germany

[21] Appl. No.: 83,698

[22] Filed: Oct. 11, 1979

[30] Foreign Application Priority Data

Jan. 4, 1979 [DE] Fed. Rep. of Germany ..... 2900176

[51] Int. Cl.[3] ..... B05B 1/32

[52] U.S. Cl. ..... 239/533.12; 239/117; 239/DIG. 19

[58] Field of Search ..... 239/DIG. 19, 114, 117, 239/533.3–533.12, 585; 123/32 JV

[56] References Cited

U.S. PATENT DOCUMENTS 4,007,880 2/1977 Hans et al. ..... 239/585

FOREIGN PATENT DOCUMENTS 144670 4/1931 Fed. Rep. of Germany ..... 239/533.3

*Primary Examiner*—Robert W. Saifer

*Attorney, Agent, or Firm*—Edwin E. Greigg

[57] ABSTRACT

An injection valve which serves as part of a fuel injection system for internal combustion engines for the purpose of injecting fuel. The injection valve comprises a nozzle body having a valve seat which cooperates with a nozzle needle, which has a needle tip arranged to protrude through an ejection opening. The needle tip and the nozzle needle are embodied as independent parts firmly connected with one another. The ejection opening is embodied in a disc, which is firmly connected with the nozzle body. In order to prevent constriction of the ejection opening during operation as a result of corrosion, the needle tip and disc are manufactured of corrosion-resistant material.

6 Claims, 1 Drawing Figure

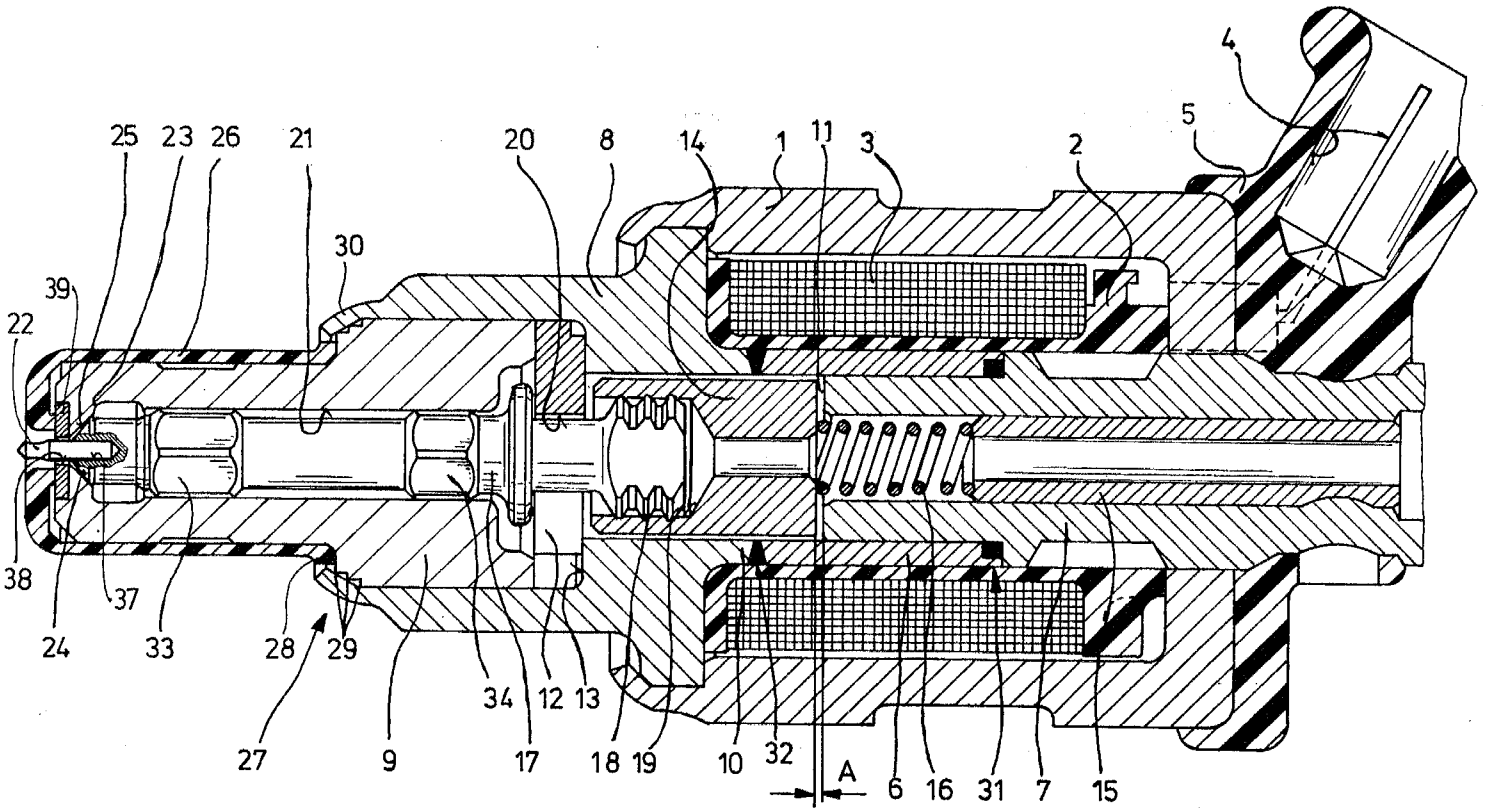
4
5
2
3
11
1
14
8
20
30
21
26
23
25
39
22
15
7
31
16
6
A
32
10
19
18
13
12
17
34
9
29
28
27
33
37
24
38

INJECTION VALVE FOR FUEL INJECTION SYSTEMS

BACKGROUND OF THE INVENTION

The invention relates to an injection valve of the type described herein and finally claimed. Injection valves are already known in which, during operation with certain kinds of fuel, the ejection opening becomes constricted, particularly in internal combustion engines with exhaust gas recirculation. The constriction which results between the cooperative elements is due in part to accumulation of deposited foreign material and in part to corrosion which in turn is also affected by the deposits. The constriction of the ejection opening results in an error in the fuel injection quantity, which not only affects the running of the internal combustion engine and the exhaust composition but also can cause the engine to eventually stop.

In other known injection valves of the type described, nozzle bodies and nozzle needles are manufactured from high-quality steel, which, because of the inferior hardness attainable in corrosion-resistant steels, causes higher wear at the valve seat, particularly at the areas of the nozzle body and needle subjected to impact and thus results in a shorter operational life of the valve. Furthermore, the expense is greater with these steels because of higher raw-material costs and the poorer machining capacity of these steels.

OBJECT AND SUMMARY OF THE INVENTION

The injection valve in accordance with the invention has the advantage over the prior art in that constriction of the ejection opening from corrosion, disadvantageous shortening of the operational life, and excessive expense are avoided to the greatest possible extent.

The invention will be better understood as well as further objects and advantages thereof become more apparent from the following detailed description of a preferred embodiment taken in conjunction with the drawing.

BRIEF DESCRIPTION OF THE DRAWING

The single FIGURE of the drawing is a cross section through a fuel injection valve according to the invention.

DESCRIPTION OF THE PREFERRED EMBODIMENT

A fuel injection valve, shown in the drawing by way of example and intended for use in a fuel injection system for an internal combustion engine, has a valve housing 1 in which are located a coil carrier 2 and a magnetic coil 3. Electric current is carried to the magnetic coil 3 through a plug connection 4 embedded in a plastic ring 5.

Within the magnetic coil 3 there is disposed a non-magnetic bushing 6, one of whose ends is welded or soldered to a connection tube 7, through which the fuel, for example gasoline, is admitted to the valve and its other end is connected in the same manner with a housing extension 8 for a nozzle body 9 forming part of the valve housing 1. The housing extension 8 has a cylindrical collar 10 whose inside and outside diameters are the same as those of the non-magnetic bushing 6 so that the seal between the two members is smooth on both the inside and the outside.

An arresting plate 12, of a particular thickness chosen for the exact adjustment of the valve, rests on an interior shoulder 13 of the housing extension 8. Disposed between this arresting plate 12 and an axial end face 11 of the connection tube 7 is located an armature 14 of the magnetic valve. The armature 14 consists of a corrosion-resistant magnetic material. Coaxially with and inside of an interior bore of the connection tube 7 lies a tube insert 15 which is fastened therein by crimping. A compression spring 16 is located within the bore of the connection tube 7 and between an end face of the tube insert 15 and an end face of the armature 14 and tends to move the armature away from the connection tube 7. A nozzle needle 17 equipped with annular lands and grooves 18 is press-fit in a bore 19 on the opposite end of the armature 14.

The nozzle needle 17 penetrates with radial clearance a bore 20 within the arresting plate 12 and a further bore 21 within the nozzle body 9 and its tip 22 extends out of the nozzle body 9. An interior shoulder 23 of the nozzle body has a conical valve seat surface 24 which cooperates with an exterior conical surface 25 on the nozzle needle 17, thereby forming the fuel injection valve 24/25. Surrounding the nozzle body 9 and the needle tip 22 is a protective sleeve 26, made of plastic or a heat-shielding material and press-fit onto the nozzle body 9. The length of the nozzle needle 17 and of the armature 14 is so chosen that, when the valve is not actuated, a clearance A obtains between its upper face and the face 11 of the connection tube 7.

A seal 27 is formed near an exterior shoulder 28 of the nozzle body 9 by providing the nozzle body 9 with at least one, by way of example, three annular edges 29 which are engaged by the outer edge 30 of the housing extension 8 which is pressed over them by a suitable tool, for example a crimping or roller tool. In this process, the hardened sealing edges 29 embed themselves into the interior wall of the softer housing extension 8, thereby forming a reliable metal-to-metal seal.

Two further seals 31 and 32 of the injection valve are provided at the respective ends of the non-magnetic sleeve 6. These seals are also metal-to-metal seals and thus are reliable and age-resistant. These seals 31 and 32 are formed either by welding or by soldering or, again, by the insertion of soft iron or copper ring seals.

In order to prevent the formation of corrosion in the valve which might affect the seals, the valve is so constructed that all interior portions of it are bathed by fuel. According to the invention, this is done by providing a nozzle needle 17 without an axial bore as has been the custom, but rather with two sets of quadruple flats 33 and 34 which provide guidance for the needle within the bore 21 and also provide an axial passage for the fuel. In this manner, the fuel flows from the direction of the armature 14 through the radial clearance between the bore 20 and the needle 17 and over the exterior surface of the nozzle needle 17. In this manner over the entire exterior surface and quadruple flats, the nozzle needle is bathed by flowing fuel.

The needle tip 22 is embodied in accordance with the invention as an independent part, inserted into a bore 37 of the nozzle needle 17 and secured therein by press-fitting, for example, or by soldering. With its end pointing in the direction of the ejected fuel, the needle tip 22 protrudes through an ejection opening 38 formed within a disc 39. The disc 39 is inserted into a suitable recess in the nozzle body 9 and secured there by welding or soldering, for example. In accordance with the invention, the needle tip 22 and/or the disc 39 should be made of corrosion-resistant material, such as high-quality steel, ceramic, or industrial glass. As a result, corrosion of the needle tip 22 and of the disc 39, which would cause a constriction of the ejection opening 38, is avoided to the greatest possible extent. By embodying only the two individual parts, the needle tip 22 and the disc 39, of the high-cost materials mentioned, problematical machining capacity is restricted to these two parts only, and costs are kept low.

The foregoing relates to a preferred exemplary embodiment of the invention, it being understood that other embodiments and variants thereof are possible within the spirit and scope of the invention, the latter being defined by the appended claims.

We claim:

1. An injection valve for fuel injection systems in internal combustion engines including a nozzle body having a valve seat, means defining an ejection opening in said valve seat, a nozzle needle arranged to cooperate with said means defining said opening in said valve seat, said nozzle needle further including a corrosion-resistant needle tip which projects through said ejection opening, further wherein said needle tip and said nozzle needle are formed of different materials and embodied as independent parts firmly connected with one another.

2. An injection valve as claimed in claim 1, further wherein said ejection opening is disposed in a disc-like member firmly connected with said nozzle body and said needle tip projects through said opening.

3. An injection valve as claimed in claim 2, further wherein said needle tip and said disc-like member are made of corrosion-resistant material.

4. An injection valve as claimed in claim 1, wherein said needle tip is made of high-quality steel.

5. An injection valve as claimed in claim 1, wherein said needle tip is made of ceramic.

6. An injection valve as claimed in claim 1, wherein said needle tip is made of glass.

* * * * *